US008722301B2

(12) United States Patent
Murakami et al.

(10) Patent No.: US 8,722,301 B2
(45) Date of Patent: May 13, 2014

(54) TRANSPARENT ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

(75) Inventors: Tsuyoshi Murakami, Kanagawa (JP); Satoshi Yoshida, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 0 days.

(21) Appl. No.: 13/445,403

(22) Filed: Apr. 12, 2012

(65) Prior Publication Data

US 2013/0143153 A1 Jun. 6, 2013

(30) Foreign Application Priority Data

Dec. 1, 2011 (JP) ..... 2011-264066

(51) Int. Cl.
*G03G 9/00* (2006.01)
*G03G 21/18* (2006.01)

(52) U.S. Cl.
USPC ..... 430/110.4; 430/109.1; 430/123.5; 430/123.51; 430/137.14; 399/111; 399/262

(58) Field of Classification Search
USPC ..... 430/110.4, 123.51, 137.14, 123.5, 430/109.1; 399/111, 262
See application file for complete search history.

(56) References Cited

U.S. PATENT DOCUMENTS

2004/0114976 A1* 6/2004 Weber et al. ..... 399/341
2009/0016776 A1 1/2009 Priebe et al.

FOREIGN PATENT DOCUMENTS

| | | |
|---|---|---|
| JP | A-10-301119 | 11/1998 |
| JP | A-10-301339 | 11/1998 |
| JP | A-2002-236396 | 8/2002 |
| JP | A-2005-099122 | 4/2005 |
| JP | A-2005-274614 | 10/2005 |
| JP | A-2010-533318 | 10/2010 |

* cited by examiner

*Primary Examiner* — Thorl Chea
(74) *Attorney, Agent, or Firm* — Oliff PLC

(57) ABSTRACT

A transparent electrostatic charge image developing toner satisfies the relationships of the following Formulas (1), (2), and (3) wherein Dt (μm) is a volume average particle diameter, upper GSDv is an upper volume particle size distribution index, and lower GSDp is a lower number particle size distribution index:

$18 \leq Dt \leq 30$; Formula (1):

$1.05 \leq \text{upper GSDv} \leq 1.20$; Formula (2):

$1.29 \leq \text{lower GSDp} \leq 1.50$ Formula (3).

16 Claims, 1 Drawing Sheet

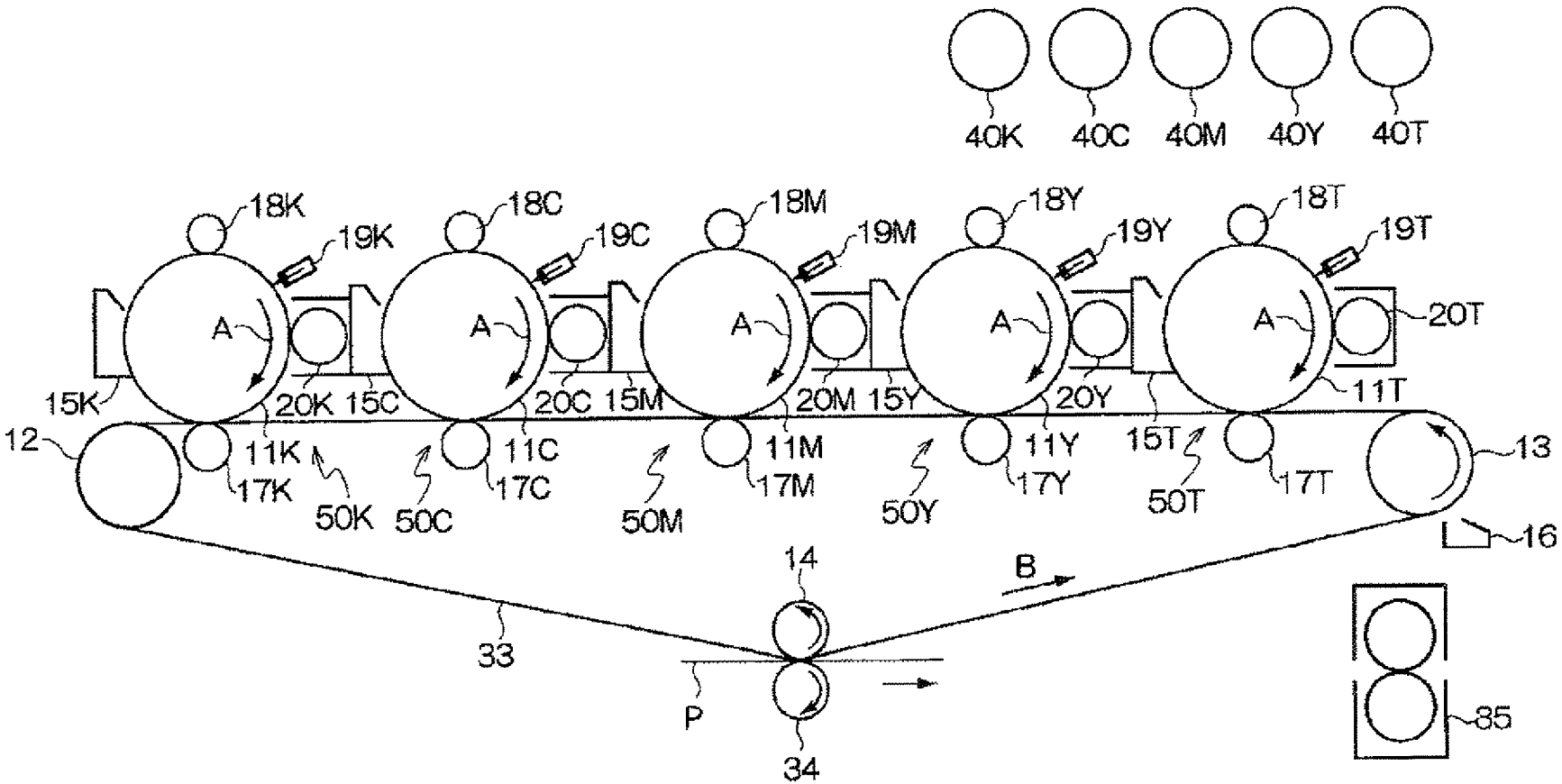
40K
40C
40M
40Y
40T
18K
19K
20K
11K
17K
15K
12
18C
19C
20C
11C
17C
15C
50C
50K
18M
19M
20M
11M
17M
15M
50M
18Y
19Y
20Y
11Y
17Y
15Y
50Y
18T
19T
20T
11T
17T
15T
50T
13
16
85
A
B
14
34
P
33

TRANSPARENT ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2011-264066 filed Dec. 1, 2011.

BACKGROUND

1. Technical Field

The present invention relates to a transparent electrostatic charge image developing toner, an electrostatic charge image developer, a toner cartridge, a process cartridge, an image forming apparatus, and an image forming method.

2. Related Art

Currently, various fields use a method of visualizing image information through an electrostatic latent image by electrophotography or the like. In electrophotography, image information is formed as an electrostatic latent image on the surface of a latent image holding member (photoreceptor) by charging and exposure processes, a toner image is developed on the surface of the photoreceptor using a developer containing a toner, and the toner image is visualized as an image through a transfer process of transferring the toner image onto a recording medium such as a sheet and a fixing process of fixing the toner image to the surface of the recording medium.

SUMMARY

According to an aspect of the invention, there is provided a transparent electrostatic charge image developing toner that satisfies the relationships of the following Formulas (1), (2), and (3) wherein Dt (μm) is a volume average particle diameter, upper GSDv is an upper volume particle size distribution index, and lower GSDp is a lower number particle size distribution index:

$18 \leq Dt \leq 30$; Formula (1):

$1.05 \leq \text{upper GSDv} \leq 1.20$; Formula (2):

$1.29 \leq \text{lower GSDp} \leq 1.50$ Formula (3).

BRIEF DESCRIPTION OF THE DRAWINGS

Exemplary embodiments of the present invention will be described in detail based on the following figures, wherein:

FIG. 1 is a diagram showing the schematic configuration of an example of an image forming apparatus according to an exemplary embodiment.

DETAILED DESCRIPTION

Hereinafter, exemplary embodiments of the invention will be described in detail.

Transparent Electrostatic Charge Image Developing Toner

A transparent electrostatic charge image developing toner according to this exemplary embodiment (hereinafter, referred to as "transparent toner") is a transparent toner that satisfies the relationships of the following Formulas (1), (2), and (3) when Dt (μm) is a volume average particle diameter, upper GSDv is an upper volume particle size distribution index, and lower GSDp is a lower number particle size distribution index.

The transparent toner is a toner that is used for a transparent toner image formed directly on a recording medium or formed on a color toner image on the recording medium for the purpose of forming a raised image. Specifically, the transparent toner is a colorless toner that does not contain a colorant or has a colorant content of 0.01% or less by weight even when containing a colorant.

$18 \leq Dt \leq 30$ Formula (1):

$1.05 \leq \text{upper GSDv} \leq 1.20$ Formula (2):

$1.29 \leq \text{lower GSDp} \leq 1.50$ Formula (3):

When the transparent toner according to this exemplary embodiment satisfies the relationships of the above Formulas (1), (2), and (3), the scattering of the transparent toner is suppressed and the formation of a raised image is realized.

The reason for this is not clear, but may be as follows.

First, in recent years, the commercial printing field has started to use the electrophotography by which printouts may be created on demand. Accordingly, it is required to obtain an image having a special effect that has been applied in the conventional printing field. For example, there is a method that is referred to as raised printing for forming a transparent resin layer having an image thickness of from about 20 μm to about 100 μm on a color image to print a raised image giving an emphasized visual and tactile impression.

In order to realize the raised image, a transparent toner having a large particle diameter may be used. Accordingly, a large amount of a transparent toner formed into a layer is directly applied to and fixed to a recording medium, or applied to and fixed to a color toner image on the recording medium to form a transparent toner image having a thickness, and thus a step is formed in comparison with a site having no transparent toner image, thereby giving an emphasized visual and tactile impression.

However, when a large particle-diameter transparent toner layer is applied, the voids (spaces in the toner) are larger than those of a toner having a small toner diameter, and a filling rate of a transparent toner layer to be formed is reduced.

Therefore, the resistivity of the toner layer is reduced, and during transfer, electric discharge occurs and the scattering of the transparent toner (so-called blurring) easily occurs.

Currently, due to the phenomena, it is difficult to realize a raised image having a high image step and suppress the scattering of a transparent toner.

On the other hand, in the case of the transparent toner according to this exemplary embodiment, the volume average particle diameter is increased, the upper volume particle size distribution index is reduced, and the lower number particle size distribution index is increased in order to realize a raised image.

The transparent toner having such particle size distribution characteristics means that a transparent toner having a large particle diameter (hereinafter, referred to as the large-diameter transparent toner) has a uniform particle diameter, and in addition to the large-diameter transparent toner, a transparent toner having a small particle diameter (hereinafter, referred to as the small-diameter transparent toner) is mixed in an appropriate amount.

Generally, the toner having a high lower number particle size distribution index causes a deterioration in image quality. However, when a raised image is formed by using a transparent toner having particle size distribution characteristics in which the volume average particle diameter is increased, the upper volume particle size distribution index is reduced, and the lower number particle size distribution index is increased, the voids present in the large-diameter transparent toner are filled with the small-diameter transparent toner, and the filling rate of the transparent toner layer before transfer may be easily increased.

Accordingly, high resistivity of the transparent toner layer before transfer is maintained, and during transfer of the transparent toner layer, the scattering of the transparent toner may be suppressed.

As described above, using the transparent toner according to this exemplary embodiment, the scattering of the transparent toner may be suppressed and the formation of a raised image may be realized.

Hereinafter, the transparent toner according to this exemplary embodiment will be described in detail.

The volume average particle diameter "Dt (μm)" of the transparent toner according to this exemplary embodiment may satisfy the following Formula (1), desirably the following Formula (1-2), and more desirably the following Formula (1-3).

$18 \leq Dt \leq 30$ Formula (1):

$20 \leq Dt \leq 29$ Formula (1-2):

$22 \leq Dt \leq 28$ Formula (1-3):

The upper volume particle size distribution index "upper GSDv" of the transparent toner according to this exemplary embodiment may satisfy the following Formula (2), desirably the following Formula (2-2), and more desirably the following Formula (2-3).

$1.05 \leq \text{upper GSDv} \leq 1.20$ Formula (2):

$1.07 \leq \text{upper GSDv} \leq 1.19$ Formula (2-2):

$1.09 \leq \text{upper GSDv} \leq 1.18$ Formula (2-3):

The lower number particle size distribution index "lower GSDp" of the transparent toner according to this exemplary embodiment may satisfy the following Formula (3), desirably the following Formula (3-2), and more desirably the following Formula (3-3).

$1.29 \leq \text{lower GSDp} \leq 1.50$ Formula (3):

$1.30 \leq \text{lower GSDp} \leq 1.48$ Formula (3-2):

$1.31 \leq \text{lower GSDp} \leq 1.46$ Formula (3-3):

Here, the volume average particle diameter and the particle size distribution of the transparent toner are values that are measured as a volume average particle diameter and a particle size distribution of transparent toner particles by using a Multisizer II measurement apparatus (manufactured by Beckman Coulter, Inc). As an electrolyte, ISOTON-II (manufactured by Beckman Coulter, Inc) is used.

Specifically, as for the measured particle size distribution, a cumulative distribution is drawn from the smallest diameter side for the respective volume and number in divided particle size ranges (channels). The particle diameter corresponding to 16% in the cumulative distribution with respect to the volume is defined as D16v, the particle diameter corresponding to 16% in the cumulative distribution with respect to the number is defined as D16p, the particle diameter corresponding to 50% in the cumulative distribution with respect to the volume is defined as D50v, the particle diameter corresponding to 50% in the cumulative distribution with respect to the number is defined as D50p, the particle diameter corresponding to 84% in the cumulative distribution with respect to the volume is defined as D84v, and the particle diameter corresponding to 84% in the cumulative distribution with respect to the number is defined as D84p.

Using the measured values, the upper volume particle size distribution index (upper GSDv) is calculated with the formula $(D84v/D50v)^{1/2}$, and the lower number particle size distribution index (lower GSDp) is calculated with the formula $(D50p/D16p)^{1/2}$.

The volume average particle diameter is D50v.

The transparent toner according to this exemplary embodiment has, for example, transparent toner particles, and if necessary, an external additive.

In addition, the transparent toner particles contain at least a binder resin and aluminum, and if necessary, other additives such as a release agent.

The binder resin will be described.

Examples of the binder resin include, but are not limited to, styrenes such as styrene, p-chlorostyrene and α-methylstyrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone and vinyl isopropenyl ketone; homopolymers including monomers of polyolefins and the like such as ethylene, propylene and butadiene or copolymers obtained by combining two or more of them, and mixtures thereof. In addition, non-vinyl condensed resins such as an epoxy resin, a polyester resin, a polyurethane resin, a polyamide resin, a cellulose resin and a polyether resin, mixtures of the resins and the above-described vinyl resins, graft polymers obtained by polymerizing a vinyl-based monomer with a coexistence of the resins, and the like are included.

The styrene resin, (meth)acrylic resin, and styrene-(meth)acrylic-based copolymer resin are obtained, for example, using a styrene-based monomer and a (meth)acrylic acid-based monomer singly or in appropriate combination, with a known method. The "(meth)acrylic" is a representation including both of "acrylic" and "methacrylic".

The polyester resin is obtained by combining and synthesizing the desirable materials selected from polyvalent carboxylic acids and polyols using, for example, a known conventional method such as a transesterification method or a polycondensation method.

When the styrene resin, (meth)acrylic resin, and copolymer resin thereof are used as a binder resin, it is desirable to use a resin having a weight average molecular weight Mw in the range of from 20,000 to 100,000 and a number average molecular weight Mn in the range of from 2,000 to 30,000. On the other hand, when the polyester resin is used as a binder resin, it is desirable to use a resin having a weight average molecular weight Mw in the range of from 5,000 to 40,000 and a number average molecular weight Mn in the range of from 2,000 to 10,000.

Here, it is particularly desirable to use at least two types of polyester resins having different glass transition temperatures in combination as a binder resin.

The difference (absolute value) between the glass transition temperatures of two types of polyester resins may be, for example, from 5° C. to 15° C. (or from about 5° C. to about 15° C.) desirably from 6° C. to 14° C., and more desirably from 7° C. to 13° C. However, when two or more types of polyester resins are employed, the temperature difference is a difference between the two types of polyester resins having the largest difference in glass transition temperature.

In addition, the content ratio (resin having a high glass transition temperature/resin having a low glass transition temperature) of two types of polyester resins may be, for example, from 80/20 to 20/80 (or from about 80/20 to about 20/80), desirably from 70/30 to 30/70, and more desirably from 60/40 to 40/60, in terms of weight ratio.

When at least two types of polyester resins having different glass transition temperatures (particularly, at least two types of polyester resins having a glass transition temperature difference in the above range) are used in combination, the upper volume particle size distribution index of the obtained transparent toner is easily reduced, and the lower number particle size distribution index easily increases.

The reason for this is as follows. In a method of granulating toner particles with an aqueous medium (particularly, aggregation coalescence method), resin particles and the like as a binder resin are aggregated, and due to the aggregation, the aggregated particles are grown and transparent toner particles are obtained. However, at this time, the particle growth rate of the aggregated particles significantly depends on the heat characteristics of the binder resin, and when two types of polyesters having different glass transition temperatures are used in combination, aggregated particles that rapidly grow in particle diameter and aggregated particles that slowly grow in particle diameter are formed, and as a result, a transparent toner having the above-described particle size distribution may be easily prepared.

In addition, the glass transition temperature (Tg) of the resin is obtained by being measured using a differential scanning calorimeter (manufactured by Shimadzu Corporation: DSC60, provided with an automatic tangential processing system) under conditions of a temperature of from the room temperature to 150° C. and a temperature increase rate of 10° C./min in accordance with an extrapolated glass transition-initiating temperature measurement method of JIS K7121-1987 "plastic transition temperature measurement method" 9.3 (2). The glass transition temperature is a temperature at the intersection point of an extension of the base line with an extension of the rising line in the heat-absorbing portion.

The release agent will be described.

Examples of the release agent include, but are not limited to, paraffin (hydrocarbon-based) wax; natural wax such as carnauba wax, rice wax and candelilla wax; synthetic or mineral and petroleum-based wax such as montan wax; ester-based wax such as fatty acid ester and montanic acid ester; and the like.

The melting temperature of the release agent is desirably about 50° C. or higher, and more desirably 60° C. or higher from the viewpoint of preservability. In addition, from the viewpoint of offset resistance, the melting point is desirably about 110° C. or lower, and more desirably 100° C. or lower.

The content of the release agent is desirably from 1 part by weight to 15 parts by weight, more desirably from 2 parts by weight to 12 parts by weight, and even more desirably from 3 parts by weight to 10 parts by weight with respect to 100 parts by weight of the binder resin.

Other additives will be described.

Examples of the other additives include a magnetic material, a charge-controlling agent, an inorganic powder and the like.

The characteristics of toner particles will be described.

The toner particles may have a single layer structure or a structure (so-called core/shell structure) constituted by a core portion and a cover layer covering the core portion.

The external additive will be described.

Examples of the external additive include inorganic particles. Examples of the inorganic particles specifically include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like.

The surface of the external additive may be subjected to a hydrophobization treatment. The hydrophobization treatment is performed by, for example, dipping inorganic particles in a hydrophobizing agent. The hydrophobizing agent is not particularly limited, and examples thereof include a silane-based coupling agent, a silicone oil, a titanate-based coupling agent, an aluminum-based coupling agent, and the like. These may be used singly or in combination of two or more types.

Generally, the amount of the hydrophobizing agent is, for example, from about 1 part by weight to about 10 parts by weight with respect to 100 parts by weight of inorganic particles.

The amount of the external additive may be preferably, for example, from about 0.5 part by weight to about 2.5 parts by weight with respect to 100 parts by weight of toner particles.

Hereinafter, the method of producing the transparent toner according to this exemplary embodiment will be described.

First, transparent toner particles may be produced by any of a dry producing method (for example, a kneading pulverization method) and a wet producing method (for example, an aggregation coalescence method, a suspension polymerization method, a dissolution suspension granulation method, a dissolution suspension method, a dissolution emulsification aggregation coalescence method and the like). The producing method is not particularly limited thereto and a well-known producing method is employed.

Among them, from the viewpoint of obtaining transparent toner particles satisfying the volume average particle diameter and the particle size distribution, a method of performing granulation in an aqueous medium, particularly, an aggregation coalescence method may be used to obtain transparent toner particles.

The transparent toner particles obtained using the aggregation coalescence method may be prepared through an aggregation process of adding an aggregating agent containing metal ions to a raw material dispersion containing at least a resin particle dispersion in which resin particles as a binder resin are dispersed and of performing heating to form aggregated particles in the raw material dispersion, a cooling process of cooling the raw material dispersion having the aggregated particles formed therein, a stopping process of stopping the growth of the cooled aggregated particles, and a coalescence process of heating the aggregated particles of which the growth in particle diameter is stopped by the stopping process to perform coalescence.

Specifically, transparent toner particles are produced as follows.

In the following description, the method of obtaining transparent toner particles containing a release agent will be described. However, the release agent is only used if necessary. Additives other than the release agent may be used.

—Resin Particle Dispersion Preparation Process—

First, in addition to the resin particle dispersion in which resin particles as a binder resin are dispersed, for example, a release agent dispersion in which release agent particles are dispersed is prepared.

Here, the resin particle dispersion is prepared by dispersing, for example, resin particles in a dispersion medium by a surfactant.

Examples of the dispersion medium used in the resin particle dispersion include an aqueous medium.

Examples of the aqueous medium include water such as distilled water and ion-exchange water, alcohols, and the like. These may be used singly or in combination of two or more types.

The surfactant is not particularly limited, and examples thereof include anionic surfactants such as sulfate-based, sulfonate-based, phosphate-based, and soap-based surfactants; cationic surfactants such as amine salt-based and quaternary ammonium salt-based surfactants; nonionic surfactants such as polyethylene glycol-based, alkylphenol ethylene oxide adduct-based, and polyol-based surfactants; and the like. Among them, anionic surfactants and cationic surfactants may be particularly used. The nonionic surfactants may be used in combination with the anionic surfactants or cationic surfactants.

The surfactants may be used singly or in combination of two or more types.

In the resin particle dispersion, examples of the method of dispersing resin particles in the dispersion medium include a general dispersing method using a rotation shearing homogenizer, a ball mill having a media, a sand mill or a DYNO-mill. In addition, in accordance with the type of resin particles to be used, for example, a phase inversion emulsification method may be used to disperse resin particles in the resin particle dispersion.

The phase inversion emulsification method is a method in which a resin to be dispersed is dissolved in a hydrophobic organic solvent in which the resin is soluble, a base is added to the organic continuous phase (O-phase) to neutralize, and an aqueous medium (W-phase) is then added, and thus conversion (so-called phase inversion) of the resin from W/O to O/W occurs, whereby a discontinuous phase is formed and the resin is dispersed in the aqueous medium in a particulate form.

The volume average particle diameter of the resin particles dispersed in the resin particle dispersion may be, for example, in the range of from 0.01 μm to 1 μm, from 0.08 μm to 0.8 μm, or from 0.1 μm to 0.6 μm.

The volume average particle diameter of the resin particles is measured by a laser diffraction particle size distribution measurement apparatus (manufactured by Horiba, Ltd., LA-920). Hereinafter, the volume average particle diameter of particles is measured in the same manner unless particular notice is given.

The content of the polyester resin particles contained in the resin particle dispersion may be, for example, from 5% by weight to 50% by weight, or from 10% by weight to 40% by weight.

For example, the release agent dispersion is also prepared in the same manner as in the case of the resin particle dispersion. That is, the volume average particle diameter of the particles in the resin particle dispersion, dispersion medium, dispersion method, and the content of the particles are the same as in the case of the release agent particles dispersed in the release agent dispersion.

—Aggregated Particle Forming Process—

Next, by adding an aggregating agent to the raw material dispersion (mixed dispersion) obtained by mixing the resin particle dispersion and the release agent particle dispersion and by performing heating to a temperature near the glass transition temperature of the resin particles (binder resin), aggregated particles in which the particles formed of the respective components are aggregated are formed.

The aggregated particles are formed, for example, by adding an aggregating agent at room temperature during stirring in a rotation shearing homogenizer.

The aggregating agent may be an aggregating agent containing mono- or higher valent metal ions. Specific examples thereof include metal salts such as calcium chloride, calcium nitrate, barium chloride, magnesium chloride, zinc chloride, aluminum chloride and aluminum sulfate, inorganic metal salt polymers such as polyaluminum chloride, polyaluminum hydroxide and polycalcium sulfate, and the like.

Among them, aluminum-based aggregating agents may be particularly used as the aggregating agent in consideration of stability of the aggregated particles, stability of the aggregating agent with respect to the heat and lapse of time, and removal upon washing.

Specific examples of the aluminum-based aggregating agents include metal salts of inorganic acids such as aluminum chloride, aluminum sulfate and aluminum nitrate, inorganic metal salt polymers such as polyaluminum chloride, and the like.

The amount of the aggregating agents added varies in accordance with the valence of the metal ions, but is small. In the case of monovalence, the amount of the aggregating agent is about 3% by weight or less of the total aggregate system, in the case of divalence, the amount of the aggregating agent is about 1% by weight or less, and in the case of trivalence, the amount of the aggregating agent is about 0.5% by weight or less. Since it is desirable that the amount of the aggregating agent be small, it is desirable to use a higher-valent compound.

The heating temperature in the aggregation process may not be determined with certainty, because it depends on the release agent amount and the aggregating agent amount added, and the like. However, in the case of a transparent toner, it is necessary to have the particles grow larger in diameter in comparison to a color toner. Accordingly, it is desirable to increase the temperature to a temperature that is the same as or slightly higher than the glass transition temperature of the binder resin. As a rough standard, the temperature may be in the range of from 0° C. to +10° C. based on the glass transition temperature of the resin particles (binder resin). When plural types of resin particles (binder resin) are used, the temperature may be in the range of from 0° C. to +10° C. based on the average value of the glass transition temperatures of the resin particles. In addition, the heating rate varies in accordance with the type and amount of the resin particles (binder resin), but may be about +1° C./15 min or higher.

—Cooling Process—

Next, it is desirable to cool the aggregated particle dispersion (raw material dispersion containing the aggregated particles) when the aggregated particles are grown up to the target range in particle diameter.

The growth of the aggregated particles in particle diameter is stopped by the stopping process to be described later. However, when the stopping process is performed without the cooling process, the aggregated particles are destroyed and the target particle diameter may not be obtained. The reason for this is that when the temperature is the same as or higher than the glass transition temperature, the molecular motion of the binder resin becomes violent, and thus when the aggregation due to the aggregating agent stops, the kinetic energy of the molecules will be excessive.

As a standard of the temperature after cooling in the cooling process, it is desirable that the temperature be in the range of from −20° C. to −10° C. based on the average value of the glass transition temperatures of the resin particles (binder resin). In addition, the cooling rate varies in accordance with the type and amount of the resin particles (binder resin), but may be about −1° C./min or higher.

—Stopping Process—

The stopping process of stopping the aggregation of the aggregated particles by adding an organic sequestering agent to the aggregated particles obtained by the cooling process may be preferably provided. In the stopping process, by adding an organic sequestering agent to the aggregated particles, the action of the metal ions is inhibited and the growth of the aggregated particles in particle diameter is rapidly stopped.

Examples of the organic sequestering agent include ethylenediaminetetraacetate (EDTA), gluconal, sodium gluconate, potassium citrate, sodium citrate, nitrotriacetate (NTA) salt, GLDA (L-glutamic acid N,N-2-acetic acid, in market), humic acid, fulvic acid, maltol, ethyl maltol pentaacetic acid, tetraacetic acid, and many water-soluble polymers (polymer electrolyte) having functional groups of both —COOH and —OH. Particularly, alkali metal salts such as EDTA and its sodium salt are desirably employed.

The amount of the organic sequestering agent added varies in accordance with the material type, but may be from 0.01% to 2.00%, and desirably from 0.10% to 1.00% with respect to the weight of the transparent toner particles. When the amount is less than 0.01%, the function of the sequestering agent may be inadequate, and when the amount is greater than 2.00%, defects such as destruction of the aggregated particles may occur.

—Coalescence Process—

Next, the aggregated particle dispersion in which the aggregated particles are dispersed is heated to, for example, the glass transition temperature or higher of the resin particles (for example, a temperature that is higher than the glass transition temperature of the resin particles by 10° C. to 30° C.) to coalesce the aggregated particles, and thus toner particles are formed.

Through the above-described processes, transparent toner particles are obtained.

In addition, transparent toner particles may be produced through a process in which after an aggregated particle dispersion in which aggregated particles are dispersed is obtained, the aggregated particle dispersion and a resin particle dispersion in which resin particles are dispersed are further mixed, and the particles are aggregated so that the resin particles further adhere to the surfaces of the aggregated particles, whereby second aggregated particles are formed, and a process in which a second aggregated particle dispersion in which the second aggregated particles are dispersed is heated, and the second aggregated particles are coalesced, whereby toner particles having a core/shell structure are formed.

Here, after the coalescence process ends, the transparent toner particles formed in the solution are subjected to a washing process, a solid-liquid separation process, and a drying process, that have become known, to obtain dried toner particles.

In the washing process, it is desirable to sufficiently perform displacement washing using ion exchange water in view of an electrostatic property. In addition, the solid-liquid separation process is not particularly limited, but in view of productivity, it is desirable to use suction filtration, pressure filtration or the like. Furthermore, the drying process is also not particularly limited, but in view of productivity, it is desirable to use freeze-drying, flash-jet drying, fluidized drying, vibration fluidized drying or the like.

In addition, for example, the toner is produced by adding an external additive to the obtained dried toner particles and mixing the materials. The mixing may be preferably performed using, for example, a V-blender, a Henschel mixer, a Loedige Mixer or the like. Furthermore, if necessary, coarse toner particles may be removed using a vibration sieve, a wind classifier or the like.

Electrostatic Charge Image Developer

An electrostatic charge image developer according to this exemplary embodiment contains the transparent toner according to this exemplary embodiment.

The electrostatic charge image developer according to this exemplary embodiment may be a single-component developer containing only the transparent toner, or a two-component developer in which the transparent toner and a carrier are mixed.

The carrier is not particularly limited, and known carriers may be used. Examples thereof include a resin-coated carrier, a magnetism dispersion-type carrier and a resin dispersion-type carrier, and the like.

The mixing ratio (weight ratio) between the transparent toner and the carrier in the two-component developer is desirably in the range of about 1:100 to about 30:100 (toner: carrier), and more desirably in the range of about 3:100 to about 20:100.

Image Forming Method, Image Forming Apparatus, Toner Cartridge, Process Cartridge An image forming method according to this exemplary embodiment has: a charging process of charging an image holding member; an electrostatic charge image forming process of forming an electrostatic charge image on a surface of the charged image holding member; a developing process of developing the electrostatic charge image formed on the image holding member as a toner image by the electrostatic charge image developer; a transfer process of transferring the transparent toner image formed on the image holding member onto a recording medium; and a fixing process of fixing the transparent toner image transferred onto the recording medium.

An image forming apparatus according to this exemplary embodiment that realizes the image forming method according to this exemplary embodiment is provided with: an image holding member; a charging section that charges the image holding member; an electrostatic charge image forming section that forms an electrostatic charge image on a surface of the charged image holding member; a developing section that contains an electrostatic charge image developer and develops the electrostatic charge image formed on the image holding member as a toner image by the electrostatic charge image developer; a transfer section that transfers the toner image formed on the image holding member onto a recording medium; and a fixing section that fixes the toner image transferred onto the recording medium.

In addition, the above-described electrostatic charge image developer according to this exemplary embodiment is applied as an electrostatic charge image developer.

In the image forming apparatus according to this exemplary embodiment, for example, a portion including the developing section containing the electrostatic charge image developer according to this exemplary embodiment may have a cartridge structure (process cartridge) that is detachable from the image forming apparatus. In addition, a portion accommodating the transparent electrostatic charge image developing toner according to this exemplary embodiment as a toner for replenishment to be supplied to the developing section may have a cartridge structure (toner cartridge) that is detachable from the image forming apparatus.

A developer containing a color toner may be used in combination with the electrostatic charge image developer containing the transparent toner according to this exemplary embodiment.

When a developer containing a color toner is used in combination, the image forming method according to this exemplary embodiment has: for example, a first image forming process of forming a color toner image of a color toner on a recording medium; a second image forming process of forming a transparent toner image of a transparent toner directly on the recording medium or on the color toner image on the recording medium; and a fixing process of fixing the color toner image and the transparent toner image on the recording medium.

In addition, when a developer containing a color toner is used in combination, the image forming apparatus according to this exemplary embodiment that realizes the image forming method according to this exemplary embodiment is provided with: a first image forming section that is provided with a first developing device accommodating a first electrostatic charge image developer having a color toner and forms a color toner image of a color toner on a recording medium; a second image forming section that is provided with a second developing device accommodating a second electrostatic charge image developer having a transparent toner and forms a transparent toner image of a transparent toner directly on the recording medium or on the color toner image on the recording medium; and a fixing section that fixes the color toner image and the transparent toner image on the recording medium.

As the first and second image forming sections, for example, an image holding member, developing devices that accommodate an electrostatic charge image developer and develop an electrostatic latent image formed on the image holding member as a toner image (color toner image, transparent toner image), respectively, and a transfer device that transfers the toner image formed on the image holding member onto a recording medium.

The first image forming section is provided with, as a developing device, a first developing device that accommodates a first electrostatic charge image developer having a color toner and develops an electrostatic latent image formed on the image holding member as a color toner image.

The second image forming section is provided with, as a developing device, a second developing device that accommodates a second electrostatic charge image developer having a transparent toner and develops an electrostatic latent image formed on the image holding member as a transparent toner image.

The first and second image forming sections may have, for example, a structure in which the image holding member, transfer device, cleaning device and the like are shared.

The image forming apparatus according to this exemplary embodiment may be, for example, an image forming apparatus that repeats sequential primary transfer of toner images held on an image holding member onto an intermediate transfer member, a tandem-type image forming apparatus in which plural latent image holding members provided with a developing section for each color are arranged in series on the intermediate transfer member, or the like.

Hereinafter, an image forming apparatus according to this exemplary embodiment will be described with reference to the drawing.

FIG. 1 is a diagram showing the schematic configuration of an example of an image forming apparatus according to this exemplary embodiment.

The image forming apparatus shown in FIG. 1 relates to a tandem-type configuration provided with plural photoreceptors as a latent image holding member, that is, plural image forming units (image forming sections). That is, in the image forming apparatus shown in FIG. 1, four image forming units 50Y, 50M, 50C, and 50K that form yellow, magenta, cyan and black images, respectively, and an image forming unit 50T that forms a transparent image are arranged in parallel at intervals (tandem form).

Here, since the image forming units 50Y, 50M, 50C, 50K, and 50T have the same configuration, except for the color of the toner in the accommodated developer, the image forming unit 50Y that forms a yellow image will be representatively described.

The same portions as in the image forming unit 50Y will be denoted by the reference numerals having magenta (M), cyan (C), black (K), and transparent color (T) added instead of yellow (Y), and descriptions of the image forming units 50M, 50C, 50K, and 50T will thus be omitted.

The yellow image forming unit 50Y is provided with a photoreceptor 11Y as a latent image holding member. The photoreceptor 11Y is driven by a driving section (not shown) to rotate in the direction of the arrow A shown in the drawing at a predetermined process speed. As the photoreceptor 11Y, for example, an organic photoreceptor having sensitivity to an infrared region is used.

A charging roll (charging section) 18Y is provided on the photoreceptor 11Y. A predetermined voltage is applied to the charging roll 18Y by a power supply (not shown), and a surface of the photoreceptor 11Y is charged to a predetermined potential.

Around the photoreceptor 11Y, an exposure device (latent image forming section) 19Y that forms an electrostatic latent image by subjecting the surface of the photoreceptor 11Y to exposure is disposed closer to the downstream side than the charging roll 18Y in the rotating direction of the photoreceptor 11Y. Here, as the exposure device 19Y, a LED array that may be miniaturized is used due to the space. However, it is not limited thereto and other latent image forming sections using laser beams and the like may also be used.

In addition, around the photoreceptor 11Y, a developing device (developing section) 20Y provided with a developer holding member that holds a yellow developer is disposed closer to the downstream side than the exposure device 19Y in the rotating direction of the photoreceptor 11Y. The developing device 20Y visualizes an electrostatic latent image formed on the surface of the photoreceptor 11Y by a yellow toner, and forms a toner image on the surface of the photoreceptor 11Y.

An intermediate transfer belt (intermediate transfer member) 33 that primarily transfers the toner image formed on the surface of the photoreceptor 11Y is disposed under the photoreceptor 11Y to go across under the five photoreceptors 11T, 11Y, 11M, 11C, and 11K. The intermediate transfer belt 33 is pressed against the surface of the photoreceptor 11Y by a primary transfer roll 17Y. In addition, the intermediate transfer belt 33 is extended between three rolls, that is, a driving roll 12, a supporting roll 13, and a bias roll 14, and is circumferentially moved in the direction of the arrow B at a moving rate that is the same as the process speed of the photoreceptor 11Y. On the surface of the intermediate transfer belt 33, a transparent toner image is primarily transferred in advance of a yellow toner image that is primarily transferred as described above. Then, the yellow toner image is primarily transferred, and magenta, cyan and black toner images are sequentially primarily transferred and stacked.

In addition, around the photoreceptor 11Y, a cleaning device 15Y for cleaning up the toner left on the surface of the photoreceptor 11Y and the retransferred toner is disposed closer to the downstream side than the primary transfer roll 17Y in the rotating direction of the photoreceptor 11Y (in the direction of the arrow A). The cleaning blade in the cleaning device 15Y is attached to be brought into pressure-contact with the surface of the photoreceptor 11Y in the counter direction.

Via the intermediate transfer belt 33, a secondary transfer roll (secondary transfer section) 34 is brought into pressure-contact with the bias roll 14 tensioning the intermediate transfer belt 33. The toner images primarily transferred onto and stacked on the surface of the intermediate transfer belt 33 are electrostatically transferred onto the surface of a recording sheet (an example of recording mediums) P fed from a sheet cassette (not shown) in the pressure-contact portion between the bias roll 14 and the secondary transfer roll 34. At this time, since the transparent toner image is at the bottom (position coming into contact with the intermediate transfer belt 33) in the toner images transferred onto and stacked on the intermediate transfer belt 33, the transparent toner image is at the top in the toner images transferred onto the surface of the recording sheet P.

In addition, in the downstream of the secondary transfer roll 34, a fixing machine (fixing section) 35 is disposed for fixing the toner images multiply transferred onto the recording sheet P to the surface of the recording sheet P by heat and pressure and for forming the resultant permanent image.

Examples of the fixing machine 35 include a belt-shaped fixing belt in which a low-surface energy material represented by a fluorine resin component and a silicone resin is used for its surface, and a cylindrical fixing roll in which a low-surface energy material represented by a fluorine resin component and a silicone resin is used for its surface.

Next, the operations of the image forming units 50T, 50Y, 50M, 50C, and 50K that form transparent, yellow, magenta, cyan, and black images, respectively, will be described. Since the operations of the image forming units 50T, 50Y, 50M, 50C, and 50K are the same, the operation of the yellow image forming unit 50Y will be representatively described.

In the developing unit 50Y for yellow, the photoreceptor 11Y rotates at a predetermined process speed in the direction of the arrow A. The charging roll 18Y charges the surface of the photoreceptor 11Y to a predetermined negative potential. Thereafter, the exposure device 19Y subjects the surface of the photoreceptor 11Y to exposure to form an electrostatic latent image according to the image information. Next, the negatively charged toner is reversely developed by the developing device 201, the electrostatic latent image formed on the surface of the photoreceptor 11Y is visualized on the surface of the photoreceptor 11Y, and a toner image is formed. Thereafter, the primary transfer roll 17Y primarily transfers the toner image on the surface of the photoreceptor 11Y onto the surface of the intermediate transfer belt 33. After primary transfer, the left transfer components such as the toner left on the surface of the photoreceptor 11Y are scraped off and cleaned up by the cleaning blade of the cleaning device 15Y, and the photoreceptor 11Y is provided for the next image forming process.

The above-described operation is performed in the image forming units 50T, 50Y, 50M, 50C, and 50K, and the toner images visualized on the surfaces of the photoreceptors 11T, 11Y, 11M, 11C, and 11K are sequentially multiply transferred onto the surface of the intermediate transfer belt 33. In the color mode, the respective color toner images are multiply transferred in an order of transparent color, yellow, magenta, cyan, and black, and in the two or three color mode, only the required color toner images are singly or multiply transferred in this order. Thereafter, the toner images singly or multiply transferred onto the surface of the intermediate transfer belt 33 are secondarily transferred onto the surface of a recording sheet P transported from the sheet cassette (not shown) by the secondary transfer roll 34. Next, the secondarily transferred images are fixed by heating and pressing in the fixing machine 35. The toner left on the surface of the intermediate transfer belt 33 after secondary transfer is cleaned up by a belt cleaner 16 formed of a cleaning blade for the intermediate transfer belt 33.

The yellow image forming unit 50Y is configured as a process cartridge, detachable from the main body of the image forming apparatus, in which the developing device 20Y including the developer holding member that holds a yellow electrostatic latent image developer, the photoreceptor 11Y, the charging roll 18Y, and the cleaning device 15Y are formed integrally with each other. In addition, the image forming units 50K, 50C, 50M, and 50T are also configured as a process cartridge as in the case of the image forming unit 50Y.

In addition, the toner cartridges 40Y, 40M, 40C, 40K, and 40T are cartridges that accommodate the respective color toners and are detachable from the image forming apparatus. These are connected to the developing devices corresponding to the respective colors by toner supply tubes (not shown). When the toner stored in each toner cartridge runs short, the toner cartridge is replaced.

EXAMPLES

Hereinafter, this exemplary embodiment will be described in more detail using examples and comparative examples, but is not limited to the examples. "Parts" means "parts by weight" unless particular notice is given.

[Preparation of Various Dispersions]

Preparation of Polyester Resin Particle Dispersion A

Bisphenol A ethylene oxide adduct (average number of moles added: 1): 250 parts

Ethylene glycol: 250 parts

Terephthalic acid: 280 parts

Succinic acid: 220 parts

The above materials, and as a catalyst, 0.08 part of dibutyltin oxide with respect to 100 parts of the raw material mixture are put into a heated and dried three-necked flask. Then, the air pressure in the container is reduced by a pressure reduction operation, an inert atmosphere is provided using a nitrogen gas, and reflux is performed for 6 hours at 180° C. by mechanical stirring.

After that, by reduced-pressure distillation, the temperature is gradually increased up to 220° C. and the materials are stirred for 5 hours. When the resultant material is sticky, the molecular weight is checked by GPC, and when the weight average molecular weight is 9000, the reduced-pressure distillation is stopped and air cooling is performed to obtain a polyester resin for core layer. The glass transition temperature Tg is 54.8° C.

The resin is transferred to CAVITRON CD1010 (manufactured by Eurotec, Ltd.) at a rate of 100 g/min in a melted state. Diluted ammonia water having a concentration of 0.37% by weight that is obtained by diluting reagent ammonia water with ion exchange water is put into a separately provided aqueous medium tank, and is transferred to the CAVITRON simultaneously with the above-described melted polyester resin material at a rate of 0.1 L/min while being heated to 120° C. by a heat exchanger. In this state, the CAVITRON is operated under conditions of a rotator's rotating rate of 60 Hz and a pressure of 5 Kg/cm$^2$, and the water amount is adjusted to adjust a resin particle concentration to 20% by weight. Thus, a polyester resin particle dispersion A is obtained that contains polyester resin particles having a volume average particle diameter of 0.18 μm.

Preparation of Polyester Resin Particle Dispersion B

Bisphenol A ethylene oxide adduct (average number of moles added: 1): 350 parts

Bisphenol A propylene oxide adduct (average number of moles added: 1): 150 parts Terephthalic acid: 150 parts Succinic acid: 220 parts Trimellitic anhydride: 130 parts The above materials, and as a catalyst, 0.08 part of dibutyltin oxide with respect to 100 parts of the raw material mixture are put into a heated and dried three-necked flask. Then, the air pressure in the container is reduced by a pressure reduction operation, an inert atmosphere is provided using a nitrogen gas, and reflux is performed for 6 hours at 180° C. by mechanical stirring.

After that, by reduced-pressure distillation, the temperature is gradually increased up to 220° C. and the materials are stirred for 5 hours. When the resultant material is sticky, the molecular weight is checked by GPC, and when the weight average molecular weight is 60000, the reduced-pressure distillation is stopped and air cooling is performed to obtain a polyester resin for core layer. The glass transition temperature Tg is 66.7° C.

The resin is transferred to CAVITRON CD1010 (manufactured by Eurotec, Ltd.) at a rate of 100 g/min in a melted state. Diluted ammonia water having a concentration of 0.37% by weight that is obtained by diluting reagent ammonia water with ion exchange water is put into a separately provided aqueous medium tank, and is transferred to the CAVITRON simultaneously with the above-described melted polyester resin material at a rate of 0.1 L/min while being heated to 120° C. by a heat exchanger. In this state, the CAVITRON is operated under conditions of a rotator's rotating rate of 60 Hz and a pressure of 5 Kg/cm$^2$, and the water amount is adjusted to adjust a resin particle concentration to 20% by weight. Thus, a polyester resin particle dispersion B is obtained that contains polyester resin particles having a volume average particle diameter of 0.17 μm.

Preparation of Polyester Resin Particle Dispersion C

Bisphenol A propylene oxide adduct (average number of moles added: 2): 300 parts Terephthalic acid: 120 parts Fumaric acid: 10 parts Dodecenyl succinic acid: 60 parts The above materials, and as a catalyst, 0.08 part of dibutyltin oxide with respect to 100 parts of the raw material mixture are put into a heated and dried three-necked flask. Then, the air pressure in the container is reduced by a pressure reduction operation, an inert atmosphere is provided using a nitrogen gas, and reflux is performed for 5 hours at 180° C. by mechanical stirring.

After that, by reduced-pressure distillation, the temperature is gradually increased up to 230° C. and the materials are stirred for 2 hours. When the resultant material is sticky, the molecular weight is checked by GPC, and when the weight average molecular weight is 20000, the reduced-pressure distillation is stopped and air cooling is performed to obtain a polyester resin for core layer. The glass transition temperature Tg is 60.3° C.

The resin is transferred to CAVITRON CD1010 (manufactured by Eurotec, Ltd.) at a rate of 100 g/min in a melted state. Diluted ammonia water having a concentration of 0.37% by weight that is obtained by diluting reagent ammonia water with ion exchange water is put into a separately provided aqueous medium tank, and is transferred to the CAVITRON simultaneously with the above-described melted polyester resin material at a rate of 0.1 L/min while being heated to 120° C. by a heat exchanger. In this state, the CAVITRON is operated under conditions of a rotator's rotating rate of 60 Hz and a pressure of 5 Kg/cm$^2$, and the water amount is adjusted to adjust a resin particle concentration to 20% by weight. Thus, a polyester resin particle dispersion C is obtained that contains polyester resin particles having a volume average particle diameter of 0.14 μm.

Preparation of Polyester Resin Particle Dispersion D

Bisphenol A ethylene oxide adduct (average number of moles added: 2): 100 parts

Bisphenol A propylene oxide adduct (average number of moles added: 2): 250 parts Terephthalic acid: 150 parts Fumaric acid: 30 parts The above materials, and as a catalyst, 0.15 part of dibutyltin oxide with respect to 100 parts of the raw material mixture are put into a heated and dried three-necked flask. Then, the air pressure in the container is reduced by a pressure reduction operation, an inert atmosphere is provided using a nitrogen gas, and reflux is performed for 5 hours at 180° C. by mechanical stirring.

After that, by reduced-pressure distillation, the temperature is gradually increased up to 230° C. and the materials are stirred for 2 hours. When the resultant material is sticky, the molecular weight is checked by GPC, and when the weight average molecular weight is 40000, the reduced-pressure distillation is stopped and air cooling is performed to obtain a polyester resin for core layer. The glass transition temperature Tg is 68.9° C.

The resin is transferred to CAVITRON CD1010 (manufactured by Eurotec, Ltd.) at a rate of 100 g/min in a melted state. Diluted ammonia water having a concentration of 0.37% by weight that is obtained by diluting reagent ammonia water with ion exchange water is put into a separately provided aqueous medium tank, and is transferred to the CAVITRON simultaneously with the above-described melted polyester resin material at a rate of 0.1 L/min while being heated to 120° C. by a heat exchanger. In this state, the CAVITRON is operated under conditions of a rotator's rotating rate of 60 Hz and a pressure of 5 Kg/cm$^2$, and the water amount is adjusted to adjust a resin particle concentration to 20% by weight. Thus, a polyester resin particle dispersion D is obtained that contains polyester resin particles having a volume average particle diameter of 0.15 μm.

Preparation of Polyester Resin Particle Dispersion E

Bisphenol A ethylene oxide adduct (average number of moles added: 2): 100 parts

Bisphenol A propylene oxide adduct (average number of moles added: 2): 200 parts Terephthalic acid: 150 parts Dodecenyl succinic acid: 50 parts Trimellitic anhydride: 10 parts The above materials, and as a catalyst, 0.07 part of dibutyltin oxide with respect to 100 parts of the raw material mixture are put into a heated and dried three-necked flask. Then, the air pressure in the container is reduced by a pressure reduction operation, an inert atmosphere is provided using a nitrogen gas, and reflux is performed for 5 hours at 180° C. by mechanical stirring.

After that by reduced-pressure distillation, the temperature is gradually increased up to 230° C. and the materials are stirred for 2 hours. When the resultant material is sticky, the molecular weight is checked by GPC, and when the weight average molecular weight is 6000, the reduced-pressure distillation is stopped and air cooling is performed to obtain a polyester resin for core layer. The glass transition temperature Tg is 51.2° C.

The resin is transferred to CAVITRON CD1010 (manufactured by Eurotec, Ltd.) at a rate of 100 g/min in a melted state. Diluted ammonia water having a concentration of 0.37% by weight that is obtained by diluting reagent ammonia water with ion exchange water is put into a separately provided aqueous medium tank, and is transferred to the CAVITRON simultaneously with the above-described melted polyester resin material at a rate of 0.1 L/min while being heated to 120° C. by a heat exchanger. In this state, the CAVITRON is operated under conditions of a rotator's rotating rate of 60 Hz and a pressure of 5 Kg/cm$^2$, and the water amount is adjusted to adj ust a resin particle concentration to 20% by weight. Thus, a polyester resin particle dispersion E is obtained that contains polyester resin particles having a volume average particle diameter of 0.12 μm.

Preparation of Stylene Acrylic Resin Particle Dispersion F (Oil Layer)

Styrene: 35 parts by weight n-butyl acrylate: 11 parts by weight

β-carboethyl acrylate: 1.5 parts by weight

Acrylic acid: 0.3 part by weight

Dodecanthiol: 0.2 part by weight (Water Layer 1)

Ion exchange water: 18.0 parts by weight

Anionic surfactant: 0.4 part by weight (Water Layer 2)

Ion exchange water: 40 parts by weight

Anionic surfactant: 0.07 part by weight

Potassium persulfate: 0.30 part by weight

Ammonium persulfate: 0.10 part by weight

The above components for an oil layer and components for a water layer 1 are put into a flask and stirred and mixed to obtain a monomer-emulsified dispersion. The components for a water layer 2 are put into the reaction container, the air in the container is sufficiently substituted with nitrogen, and during stirring, heating is performed by an oil bath until the temperature in the reaction system is adjusted to 75° C. The monomer-emulsified dispersion is gradually added dropwise into the reaction container over 3 hours and emulsification polymerization is performed. After adding dropwise, polymerization is further continuously performed at 75° C., and after 3 hours, the polymerization is ended.

The obtained styrene acrylic resin particle dispersion F has a volume average particle diameter of 0.21 μm, a glass transition temperature of 53.5° C., a weight average molecular weight of 35000, and a resin particle concentration of 43% by weight.

Colorant Dispersion A

Cyan pigment (prepared by Dainichiseika Color & Chemicals Mfg. Co., Ltd., Pigment Blue 15:3 (copper phthalocyanine)): 1000 parts by weight Anionic surfactant (prepared by Dai-ichi Kogyo Seiyaku Co., Ltd., NEOGEN R): 15 parts by weight Ion exchange water: 9000 parts by weight The above materials are mixed, dissolved, and dispersed for about 1 hour using a high-pressure impact dispersing machine Altimizer (manufactured by Sugino Machine, Ltd., HJP30006) to prepare a colorant dispersion A in which the colorant (pigment) is dispersed. The volume average particle diameter of the colorant (pigment) particles in the colorant dispersion is 0.16 μm, and a solid content concentration is 20%.

Preparation of Release Agent Dispersion A

Paraffin wax HNP9 (melting temperature: 76° C., prepared by Nippon Seiro Co., Ltd): 60 parts Ionic Surfactant (NEOGEN RK, prepared by Dai-ichi Kogyo Seiyaku Co., Ltd.): 5 parts Ion exchange water: 240 parts A solution obtained by mixing the above components is heated to 95° C. to sufficiently perform dispersion by ULTRA-TURRAX T50 manufactured by IKA Works Gmbh & Co. KG. Then, a pressure discharge-type Gaulin homogenizer performs the dispersion process, and a release agent dispersion A is obtained that has a volume average diameter of 220 nm and a solid content amount of 20% by weight.

[Preparation of Transparent Toner]

Preparation of Transparent Toner Particles T1

Amorphous polyester resin particle dispersion A: 400 parts

Amorphous polyester resin particle dispersion B: 400 parts

Release agent dispersion A: 100 parts

The above components are stirred with 550 parts by weight of ion exchange water in a round stainless steel flask and the temperature is adjusted to 20° C. Thereafter, mixing and dispersion are sufficiently performed by ULTRA-TURRAX T50.

To the resultant material, 150 parts by weight of an aqueous aluminum sulfate solution (corresponding to $Al_2(SO_3)_4$, parts by weight) are added, and the dispersion operation is continuously performed by ULTRA-TURRAX. Then, the flask is heated up to 64° C. at a rate of 1° C./15 min by an oil bath for heating during stirring, and is held for 20 minutes. Then, the flask is cooled up to 45° C. at a cooling rate of 1° C./1 min by cooling with wind. Then, EDTA-4Na tetrahydrate is added in an amount of 1.0% of the solid content (toner particle content) in the slurry, and then the pH in the system is adjusted to 7.5 with 1 Mol/L of a sodium hydroxide aqueous solution. Thereafter, the stainless steel flask is sealed and heated up to 95° C. while stirring is continuously performed using a magnetic seal, and the flask is left at 95° C. while stirring is performed for 3 hours.

Then, using a multitubular heat exchanger (heating medium is 5° C. cold water), rapid cooling up to 30° C. is performed at a flow rate adjusted for achieving a cooling rate of 30° C./min. After that, filtration and sufficient washing with ion exchange water are performed, and then solid-liquid separation is performed by Nutsche-type suction filtration.

Furthermore, the filtrate is subjected to re-dispersion in 3 L of ion exchange water at 43° C., and is subjected to stirring at 300 rpm for 15 minutes and washing. This process is further repeated 5 times. When the electrical conductivity of the filtrate is 15 μS/cm, solid-liquid separation is performed by Nutsche-type suction filtration using No. 5A filter paper. Next, vacuum drying is continuously performed for 12 hours.

Transparent toner particles T1 are prepared through the processes.

When the particle size of the transparent toner particles T1 is measured, the volume average particle diameter (Dt) is 24.0 μm. The upper volume particle size distribution index (upper GSDv) is 1.15, the lower number particle size distribution index (lower GSDp) is 1.38, and the shape factor SF1 is 134.

Preparation of Transparent Toner Particles T2

Transparent toner particles T2 are prepared in the same manner as in the case of the transparent toner particles T1, except that the growth promoting temperature of the aggregated particles is changed from 64° C. to 58° C. in the producing of the transparent toner particles T1.

Preparation of Transparent Toner Particles T3

Transparent toner particles T3 are prepared in the same manner as in the case of the transparent toner particles T1, except that the amount of the amorphous polyester resin particle dispersion A added is changed from 400 parts to 600 parts, the amount of the amorphous polyester resin particle dispersion B added is changed from 400 parts to 200 parts, and the growth promoting temperature of the aggregated particles is changed from 64° C. to 56° C. in the producing of the transparent toner particles T1.

Preparation of Transparent Toner Particles T4

Transparent toner particles T4 are prepared in the same manner as in the case of the transparent toner particles T1, except that the growth promoting temperature of the aggregated particles is changed from 64° C. to 67° C. in the producing of the transparent toner particles T1.

Preparation of Transparent Toner Particles T5

Transparent toner particles T5 are prepared in the same manner as in the case of the transparent toner particles T1, except that the amount of the amorphous polyester resin particle dispersion A added is changed from 400 parts to 200 parts, the amount of the amorphous polyester resin particle dispersion B added is changed from 400 parts to 600 parts, and the growth promoting temperature of the aggregated particles is changed from 64° C. to 68° C. in the producing of the transparent toner particles T1.

Preparation of Transparent Toner Particles T6

Transparent toner particles T6 are prepared in the same manner as in the case of the transparent toner particles T1, except that the amorphous polyester resin particle dispersion B is changed to the amorphous polyester resin particle dispersion C, and the growth promoting temperature of the aggregated particles is changed from 64° C. to 60° C. in the producing of the transparent toner particles T1.

Preparation of Transparent Toner Particles T7

Transparent toner particles T7 are prepared in the same manner as in the case of the transparent toner particles T1, except that the amorphous polyester resin particle dispersion B is changed to the amorphous polyester resin particle dispersion D in the producing of the transparent toner particles T1.

Preparation of Transparent Toner Particles T8

Transparent toner particles T8 are prepared in the same manner as in the case of the transparent toner particles T1, except that the amorphous polyester resin particle dispersion A is changed to the amorphous polyester resin particle dispersion C in the producing of the transparent toner particles T1.

Preparation of Transparent Toner Particles T9

Transparent toner particles T9 are prepared in the same manner as in the case of the transparent toner particles T8, except that the amount of the amorphous polyester resin particle dispersion C added is changed from 400 parts to 200 parts, and the amount of the amorphous polyester resin particle dispersion B added is changed from 400 parts to 600 parts in the producing of the transparent toner particles T0.

Preparation of Transparent Toner Particles T10

Transparent toner particles T10 are prepared in the same manner as in the case of the transparent toner particles T8, except that the amount of the amorphous polyester resin particle dispersion C added is changed from 400 parts to 600 parts, and the amount of the amorphous polyester resin particle dispersion B added is changed from 400 parts to 200 parts in the producing of the transparent toner particles 18.

Preparation of Transparent Toner Particles T11

Transparent toner particles T11 are prepared in the same manner as in the case of the transparent toner particles T8, except that the amount of the amorphous polyester resin particle dispersion C added is changed from 400 parts to 480 parts, the amount of the amorphous polyester resin particle dispersion B added is changed from 400 parts to 320 parts, and the growth promoting temperature of the aggregated particles is changed from 64° C. to 62° C. in the producing of the transparent toner particles T8.

Preparation of Transparent Toner Particles T12

Transparent toner particles T12 are prepared in the same manner as in the case of the transparent toner particles T6, except that the amount of the amorphous polyester resin particle dispersion A added is changed from 400 parts to 480 parts, the amount of the amorphous polyester resin particle dispersion C added is changed from 400 parts to 320 parts, and the growth promoting temperature of the aggregated particles is changed from 64° C. to 65° C. in the producing of the transparent toner particles T6.

Preparation of Transparent Toner Particles T13

Transparent toner particles T13 are prepared in the same manner as in the case of the transparent toner particles T7, except that the growth promoting temperature of the aggregated particles is changed from 64° C. to 69° C. in the producing of the transparent toner particles T7.

Preparation of Transparent Toner Particles T14

Transparent toner particles T14 are prepared in the same manner as in the case of the transparent toner particles T12, except that the amount of the amorphous polyester resin particle dispersion A added is changed from 480 parts to 160 parts, the amount of the amorphous polyester resin particle dispersion C added is changed from 320 parts to 640 parts, and the growth promoting temperature of the aggregated particles is changed from 65° C. to 68° C. in the producing of the transparent toner particles T12.

Preparation of Transparent Toner Particles T15

Transparent toner particles T15 are prepared in the same manner as in the case of the transparent toner particles T12, except that the amount of the amorphous polyester resin particle dispersion A added is changed from 480 parts to 640 parts, and the amount of the amorphous polyester resin particle dispersion C added is changed from 320 parts to 160 parts in the producing of the transparent toner particles T12.

Preparation of Transparent Toner Particles T16

Transparent toner particles T16 are prepared in the same manner as in the case of the transparent toner particles T1, except that the growth promoting temperature of the aggregated particles is changed from 64° C. to 55° C. in the producing of the transparent toner particles T1.

Preparation of Transparent Toner Particles T17

Transparent toner particles T17 are prepared in the same manner as in the case of the transparent toner particles T1, except that the amount of the amorphous polyester resin particle dispersion A added is changed from 400 parts to 680 parts, the amount of the amorphous polyester resin particle dispersion B added is changed from 400 parts to 120 parts, and the growth promoting temperature of the aggregated particles is changed from 64° C. to 52° C. in the producing of the transparent toner particles T1.

Preparation of Transparent Toner Particles T18

Transparent toner particles T18 are prepared in the same manner as in the case of the transparent toner particles T1, except that the growth promoting temperature of the aggregated particles is changed from 64° C. to 73° C. in the producing of the transparent toner particles T1.

Preparation of Transparent Toner Particles T19

Transparent toner particles T19 are prepared in the same manner as the case of the transparent toner particles T1, except that the amount of the amorphous polyester resin particle dispersion A added is changed from 400 parts to 120 parts, the amount of the amorphous polyester resin particle dispersion B added is changed from 400 parts to 680 parts, and the growth promoting temperature of the aggregated particles is changed from 64° C. to 75° C. in the producing of the transparent toner particles T1.

Preparation of Transparent Toner Particles T20

Transparent toner particles T20 are prepared in the same manner as in the case of the transparent toner particles T1, except that the amorphous polyester resin particle dispersion A is changed to the amorphous polyester resin particle dispersion D in the producing of the transparent toner particles T1.

Preparation of Transparent Toner Particles T21

Transparent toner particles T21 are prepared in the same manner as in the case of the transparent toner particles T20, except that the amount of the amorphous polyester resin particle dispersion B added is changed from 400 parts to 680 parts, and the amount of the amorphous polyester resin particle dispersion D added is changed from 400 parts to 120 parts in the producing of the transparent toner particles T20.

Preparation of Transparent Toner Particles T22

Transparent toner particles T22 are prepared in the same manner as in the case of the transparent toner particles T20, except that the growth promoting temperature of the aggregated particles is changed from 64° C. to 78° C. in the producing of the transparent toner particles T20.

Preparation of Transparent Toner Particles T23

Transparent toner particles T23 are prepared in the same manner as in the case of the transparent toner particles T21, except that the growth promoting temperature of the aggregated particles is changed from 64° C. to 78° C. in the producing of the transparent toner particles T21.

Preparation of Transparent Toner Particles T24

Transparent toner particles T24 are prepared in the same manner as in the case of the transparent toner particles T20, except that the amorphous polyester resin particle dispersion B is changed to the amorphous polyester resin particle dispersion B, and the growth promoting temperature of the aggregated particles is changed from 64° C. to 60° C. in the producing of the transparent toner particles T20.

Preparation of Transparent Toner Particles T25

Transparent toner particles T25 are prepared in the same mariner as in the case of the transparent toner particles T24, except that the amount of the amorphous polyester resin particle dispersion E added is changed from 400 parts to 640 parts, and the amount of the amorphous polyester resin particle dispersion D added is changed from 400 parts to 160 parts in the producing of the transparent toner particles T24.

Preparation of Transparent Toner Particles T26

Transparent toner particles T26 are prepared in the same manner as in the case of the transparent toner particles T24, except that the growth promoting temperature of the aggregated particles is changed from 60° C. to 71° C. in the producing of the transparent toner particles T24.

Preparation of Transparent Toner Particles T27

Transparent toner particles T27 are prepared in the same manner as in the case of the transparent toner particles T25, except that the growth promoting temperature of the aggregated particles is changed from 60° C. to 67° C. in the producing of the transparent toner particles T25.

Preparation of Transparent Toner Particles T28

Transparent toner particles T28 are prepared in the same manner as in the case of the transparent toner particles T1, except that the amount of the amorphous polyester resin particle dispersion A added is changed from 400 parts to 800 parts, the amorphous polyester resin particle dispersion B is not added, the growth promoting temperature of the aggregated particles is changed from 64° C. to 60° C., and in the cooling process after aggregation, cooling is performed up to 40° C. at a cooling rate of 0.5° C./min in the producing of the transparent toner particles T1.

Preparation of Transparent Toner Particles T29

Transparent toner particles T29 are prepared in the same manner as in the case of the transparent toner particles T28, except that the amorphous polyester resin particle dispersion A is changed to the amorphous styrene acrylic resin particle dispersion F, the growth promoting temperature of the aggregated particles is changed from 60° C. to 63° C., and in the cooling process after aggregation, cooling is performed up to 35° C. at a cooling rate of 0.5° C./min in the producing of the transparent toner particles T28.

[Preparation of Color Toner Particles]

Preparation of Color Toner Particles C1

Polyester resin particle dispersion A: 267 parts by weight

Colorant Dispersion A: 25 parts by weight

Release agent dispersion A: 40 parts by weight

Anionic surfactant (Teyca Power): 2.0 parts by weight

The above raw materials are put into a 2 L-cylindrical stainless steel container. Using a homogenizer (manufactured by IKA Works Gmbh & Co. KG, ULTRA-TURRAX T50), at a homogenizer rotating speed set to 4000 rpm, dispersion is performed for mixing for 10 minutes while a shearing force is added. Next, 1.75 parts by weight of a 10%-nitric acid aqueous solution of polyaluminum chloride are gradually added dropwise as an aggregating agent, and dispersion is performed for mixing for 15 minutes at the homogenizer rotating speed set to 5000 rpm. In this manner, a raw material dispersion is obtained.

Then, the raw material dispersion is moved to a polymerization kettle provided with a stirring device and a thermometer, and heating using a mantle heater is started to promote the growth of the aggregated particles at 42° C. At this time, the pH of the raw material dispersion is adjusted in the range of from 3.2 to 3.8 using a 1 N sodium hydroxide aqueous solution or 0.3 N nitric acid. The raw material dispersion of which the pH is held in the above-described pH range is left for about 2 hours and aggregated particles are formed. The volume average particle diameter of the aggregated particles is 4.9 μm.

Next, 100 parts by weight of a polyester resin particle dispersion (A1) are added to the raw material dispersion, and the resin particles of a polyester resin (1) are adhered to the surfaces of the aggregated particles. Furthermore, the temperature of the raw material dispersion is increased to 44° C., and the aggregated particles are arranged while the particle size and shape are confirmed using an optical microscope and Multisizer II. Thereafter, EDTA-4Na tetrahydrate is added in an amount of 2.0% of the solid content (toner mother particle content) in the slurry, and then the pH in the system is adjusted to 7.5 with 1 Mol/L of a sodium hydroxide aqueous solution. Thereafter, the resultant material is heated up to 85° C. while being stirred continuously, and is left at 85° C. while stirring is performed for 3 hours. Then, using a multitubular heat exchanger (heating medium is 5° C. cold water), rapid cooling up to 30° C. is performed at a flow rate adjusted for achieving a cooling rate of 30° C./min.

Next, the raw material dispersion is filtered, and the obtained toner particles after solid-liquid separation are dispersed in ion exchange water at 30° C., of which the amount is 20 times the amount of the solid toner particle content, to perform water washing.

After the water washing is repeated 10 times, a loop-type air flow dryer is used to perform drying and classification in cyclone collection. Whereby, color toner particles C1 are obtained.

[Preparation of Toners]

Preparation of Transparent Toners T1 to T29

As for the prepared transparent toner particles T1 to T29, as external additives, 0.2 part of titania treated with decyltrimethoxysilane having a volume average particle diameter of 30 nm and 0.4 part of silica treated with hexamethyldisilazane having a volume average particle diameter of 100 nm are mixed per 100 parts of transparent toner particles in a 5 L-Henschel mixer (manufactured by Mitsui Miike Chemical Engineering Machinery Co., Ltd.) for 10 minutes. The mixture is sieved with a wind classifier HIBOLTER NR300 (manufactured by Tokyo Kikai Seisakusho, Ltd.) (mesh opening size: 45 μm), and transparent toners T1 to T29 are prepared.

Preparation of Color Toner C1

As for the prepared color toner particles C1, as external additives, 0.8 part of titania treated with decyltrimethoxysilane having a volume average particle diameter of 30 nm and 1.2 parts of silica treated with hexamethyldisilazane having a volume average particle diameter of 100 nm are mixed per 100 parts of toner particles in a 5 L-Henschel mixer (manufactured by Mitsui Miike Chemical Engineering Machinery Co., Ltd) for 10 minutes. The mixture is sieved with a wind-power sieving machine HIBOLTER NR300 (manufactured by Tokyo Kikai Seisakusho, Ltd.) (mesh opening size: 45 μm), and a color toner C1 is prepared.

Examples 1 to 17, Comparative Examples 1 to 12

The transparent toners according to Table 1 are set as examples and comparative examples, respectively. The transparent toners in the respective examples are evaluated as a toner set with the color toner C1.

In addition, characteristics of the transparent toners in the respective examples are shown in Table 1 as a list.

[Evaluation]

Preparation of Developer Set 12 parts of a transparent toner in each example and 88 parts of the following carrier (1) are mixed by a V-blender to prepare a developer.

8 parts of a color toner C1 and 92 parts of the following carrier (2) are mixed by a V-blender to prepare a developer.

—Carrier (1)—

Using a kneader, ferrite cores having an average particle diameter of 100 μm are coated with 0.3% by weight of a silicone resin (prepared by Toray Dow-Corning Inc.: SR2411) in terms of weight ratio to obtain a carrier (1)

—Carrier (2)—

Using a kneader, ferrite cores having an average particle diameter of 35 μm are coated with 0.8% by weight of a silicone resin (prepared by Toray Dow-Corning Inc.: SR2411) in terms of weight ratio to obtain a carrier (2).

—Experimental Evaluation—

A developer of a transparent toner for each example is put into a fifth engine of a Color 1000 Press modifier manufactured by Fuji Xerox Co., Ltd (modifier modified to be able to perform an output operation even when one developer is put into the developing machine), and a developer of a color toner C1 is put into one of other engines to form a raised print image using the transparent toner.

The image is created by overlapping a 5 cm×5 cm solid image of the transparent toner with the center portion of a 10 cm×10 cm solid image of the color toner. After the image is fixed, the image is scanned from the color toner image portion to the transparent toner image portion by a surface roughness meter (Surfcom) and a height profile is created (longitudinal magnification: 500 times, lateral magnification: 20 times). When the height of the color toner image portion is set to zero, the point at which the image height is 3 μm is denoted by X1, and the point at which the image height is maximum is denoted by X2, a difference in height (X2-X1) is an image step. The measurement is performed at 5 sites for each image, and an average of the values of the 3 points except for the maximum and minimum values is employed. The value of the image step is rated on a scale of the following four symbols, A, B, C, D.

A: 26 μm or greater

B: from 21 μm to less than 26 μm

C: from 15 μm to less than 21 μm

D: less than 15 μm

In addition, the scattering level of the transparent toner at the boundary portion between the color toner image portion and the transparent toner image portion is observed and rated on a scale of four levels represented by the four symbols, A, B, C, D. The evaluation standard is as follows.

A: level at which the scattering of a transparent toner is not shown at the image boundary portion even when being observed with a loupe having a magnification of 50 times B: level at which the scattering of a transparent toner is slightly shown at the image boundary portion when being observed with a loupe having a magnification of 50 times, but may not be confirmed visually.

C: level at which the scattering is slightly observed when being visually scrutinized, but there is no practical problem.

D: level at which the scattering is easily observed visually, and there is a practical problem.

TABLE 1

| | Transparent Toner | | | | | | | |
|---|---|---|---|---|---|---|---|---|
| | | | Particle | | | Evaluation | | |
| | Type | Resin Particle Dispersion Type In parentheses = Glass Transition Temperature of Resin | Diameter Dt (μm) | Upper GSDv (—) | Lower GSDp (—) | Image Step (μm) | | Transparent Toner Scattering |
| Example 1 | T1 | A (54.8° C.), B (66.7° C.) | 24 | 1.15 | 1.38 | 27 | A | A |
| Example 2 | T2 | A (54.8° C.), B (66.7° C.) | 18 | 1.05 | 1.35 | 21 | B | B |
| Example 3 | T3 | A (54.8° C.), B (66.7° C.) | 18 | 1.20 | 1.36 | 20 | B | B |
| Example 4 | T4 | A (54.8° C.), B (66.7° C.) | 30 | 1.05 | 1.35 | 32 | A | C |
| Example 5 | T5 | A (54.8° C.), B (66.7° C.) | 30 | 1.20 | 1.36 | 35 | A | B |
| Example 6 | T6 | A (54.8° C.), C (60.3° C.) | 24 | 1.16 | 1.29 | 25 | B | B |
| Example 7 | T7 | A (54.8° C.), D (68.9° C.) | 24 | 1.15 | 1.50 | 26 | A | B |

TABLE 1-continued

| | Transparent Toner | | | | | Evaluation | | |
|---|---|---|---|---|---|---|---|---|
| | Type | Resin Particle Dispersion Type In parentheses = Glass Transition Temperature of Resin | Particle Diameter Dt (μm) | Upper GSDv (—) | Lower GSDp (—) | Image Step (μm) | | Transparent Toner Scattering |
| Example 8 | T8 | B (66.7° C.), C (60.3° C.) | 18 | 1.05 | 1.29 | 19 | C | B |
| Example 9 | T9 | B (66.7° C.), C (60.3° C.) | 18 | 1.05 | 1.49 | 20 | C | A |
| Example 10 | T10 | B (66.7° C.), C (60.3° C.) | 18 | 1.20 | 1.30 | 21 | B | B |
| Example 11 | T11 | B (66.7° C.), C (60.3° C.) | 18 | 1.20 | 1.49 | 22 | B | A |
| Example 12 | T12 | A (54.8° C.), C (60.3° C.) | 30 | 1.05 | 1.29 | 29 | A | B |
| Example 13 | T13 | A (54.8° C.), D (68.9° C.) | 30 | 1.05 | 1.50 | 30 | A | B |
| Example 14 | T14 | A (54.8° C.), C (60.3° C.) | 30 | 1.20 | 1.29 | 29 | A | C |
| Example 15 | T15 | A (54.8° C.), C (60.3° C.) | 30 | 1.20 | 1.49 | 26 | A | B |
| Comparative Example 1 | T16 | A (54.8° C.), B (66.7° C.) | 17 | 1.03 | 1.35 | 13 | D | B |
| Comparative Example 2 | T17 | A (54.8° C.), B (66.7° C.) | 17 | 1.21 | 1.34 | 14 | D | C |
| Comparative Example 3 | T18 | A (54.8° C.), B (66.7° C.) | 31 | 1.04 | 1.36 | 24 | B | D |
| Comparative Example 4 | T19 | A (54.8° C.), B (66.7° C.) | 31 | 1.22 | 1.35 | 26 | A | D |
| Comparative Example 5 | T20 | B (66.7° C.), D (68.9° C.) | 17 | 1.04 | 1.26 | 12 | D | C |
| Comparative Example 6 | T21 | B (66.7° C.), D (68.9° C.) | 17 | 1.21 | 1.25 | 13 | D | C |

TABLE 2

| | Transparent Toner | | | | | Evaluation | | |
|---|---|---|---|---|---|---|---|---|
| | Type | Resin Particle Dispersion Type In parentheses = Glass Transition Temperature of Resin | Particle Diameter Dt (μm) | Upper GSDv (—) | Lower GSDp (—) | Image Step (μm) | | Transparent Toner Scattering |
| Comparative Example 6 | T21 | B (66.7° C.), D (68.9° C.) | 17 | 1.21 | 1.25 | 13 | D | C |
| Comparative Example 7 | T22 | B (66.7° C.), D (68.9° C.) | 31 | 1.03 | 1.25 | 25 | B | D |
| Comparative Example 8 | T23 | B (66.7° C.), D (68.9° C.) | 31 | 1.21 | 1.28 | 22 | B | D |
| Comparative Example 9 | T24 | D (68.9° C.), E (51.2° C.) | 17 | 1.04 | 1.52 | 12 | D | C |
| Comparative Example 10 | T25 | D (68.9° C.), E (51.2° C.) | 17 | 1.22 | 1.53 | 14 | D | B |
| Comparative Example 11 | T26 | D (68.9° C.), E (51.2° C.) | 31 | 1.04 | 1.51 | 23 | B | D |
| Comparative Example 12 | T27 | D (68.9° C.), E (51.2° C.) | 31 | 1.21 | 1.52 | 24 | B | D |
| Example 16 | T28 | A (54.8° C.) | 25 | 1.07 | 1.35 | 22 | B | B |
| Example 17 | T29 | F (53.5° C.) | 26 | 1.09 | 1.30 | 23 | B | C |

From the above-described results, it is found that a raised image having a higher image step is formed and the scattering of a transparent toner is more suppressed in the examples than in the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transparent electrostatic charge image developing toner that satisfies the relationships of the following Formulas (1), (2), and (3) wherein Dt (μm) is a volume average particle diameter, upper GSDv is an upper volume particle size distribution index, and lower GSDp is a lower number particle size distribution index:

$$18 \leq Dt \leq 30; \quad \text{Formula (1):}$$

$$1.05 \leq \text{upper GSDv} \leq 1.20; \quad \text{Formula (2):}$$

$$1.29 \leq \text{lower GSDp} \leq 1.50, \quad \text{Formula (3):}$$

wherein the toner contains a binder resin including at least two types of polyester resins having different glass transition temperatures.

2. The transparent electrostatic charge image developing toner according to claim 1, wherein a difference between the glass transition temperatures of the two types of polyester resins is from about 5° C. to about 15° C.

3. The transparent electrostatic charge image developing toner according to claim 1, wherein a content ratio (resin having a high glass transition temperature/resin having a low glass transition temperature) of the two types of polyester resins is from about 80/20 to about 20/80 in terms of weight ratio.

4. The transparent electrostatic charge image developing toner according to claim 1, wherein the toner contains aluminum.

5. The transparent electrostatic charge image developing toner according to claim 1, wherein the toner contains a release agent.

6. The transparent electrostatic charge image developing toner according to claim 5, wherein a melting temperature of the release agent is from about 50° C. to about 110° C.

7. The transparent electrostatic charge image developing toner according to claim 5, wherein the release agent is paraffin wax.

8. The transparent electrostatic charge image developing toner according to claim 1, wherein the toner contains inorganic particles as an external additive.

9. The transparent electrostatic charge image developing toner according to claim 8, wherein the inorganic particles are hydrophobized by a hydrophobizing agent, and the amount of the hydrophobizing agent is from about 1 part by weight to about 10 parts by weight with respect to 100 parts by weight of the inorganic particles.

10. The transparent electrostatic charge image developing toner according to claim 8, wherein the amount of the external additive externally added is from about 0.5 part by weight to about 2.5 parts by weight with respect to 100 parts by weight of the toner particles.

11. The transparent electrostatic charge image developing toner according to claim 1, that is prepared by an aggregation coalescence method comprising an aggregation process of forming aggregated particles in a raw material dispersion by adding an aggregating agent containing aluminum ions to the raw material dispersion containing a resin particle dispersion in which resin particles as a binder resin are dispersed and by heating the raw material dispersion, a cooling process of cooling the raw material dispersion in which the aggregated particles are formed, a stopping process of stopping the growth of the cooled aggregated particles, and a coalescence process of coalescing the aggregated particles, of which the growth in particle diameter is stopped by the stopping process, by heating.

12. An electrostatic charge image developer comprising:

the transparent electrostatic charge image developing toner according to claim 1.

13. A toner cartridge that contains the transparent electrostatic charge image developing toner according to claim 1 and is detachable from an image forming apparatus.

14. A process cartridge that is detachable from an image forming apparatus, comprising:

a developing section that contains the electrostatic charge image developer according to claim 12 and develops an electrostatic charge image formed on an image holding member as a transparent toner image by the electrostatic charge image developer.

15. An image forming apparatus comprising:

an image holding member;

a charging section that charges the image holding member;

an electrostatic charge image forming section that forms an electrostatic charge image on a surface of the charged image holding member;

a developing section that contains the electrostatic charge image developer according to claim 12 and develops the electrostatic charge image formed on the image holding member as a transparent toner image by the electrostatic charge image developer;

a transfer section that transfers the transparent toner image formed on the image holding member onto a recording medium; and a fixing section that fixes the transparent toner image transferred onto the recording medium.

16. An image forming method comprising:

charging an image holding member;

forming an electrostatic charge image on a surface of the charged image holding member;

developing the electrostatic charge image formed on the image holding member as a transparent toner image by the electrostatic charge image developer according to claim 12;

transferring the transparent toner image formed on the image holding member onto a recording medium; and fixing the transparent toner image transferred onto the recording medium.

* * * * *